US009573408B2

(12) United States Patent
Goodfellow et al.

(10) Patent No.: US 9,573,408 B2
(45) Date of Patent: Feb. 21, 2017

(54) RESILIENT ROD FEATURE IN HANGING FILE FOLDER

(75) Inventors: Andrew Goodfellow, Phoenix, AZ (US); David Gruza, Phoenix, AZ (US); Christopher Holman, Mesa, AZ (US); Candie Harris, Brookville, NY (US); Braden Jones, Phoenix, AZ (US)

(73) Assignee: LSC COMMUNICATIONS US, LLC, Chicago, IL (US)

( * ) Notice: Subject to any disclaimer, the term of this patent is extended or adjusted under 35 U.S.C. 154(b) by 1416 days.

(21) Appl. No.: 11/877,045

(22) Filed: Oct. 23, 2007

(65) Prior Publication Data

US 2009/0101605 A1 Apr. 23, 2009

(51) Int. Cl.
*B42F 15/00* (2006.01)

(52) U.S. Cl.
CPC ..... *B42F 15/0035* (2013.01); *B42F 15/0064* (2013.01)

(58) Field of Classification Search
USPC ..... 211/45, 46, 85.3, 100, 105, 105.1, 123,211/124, 126.13, 182, 191, 204, 206; 248/304, 248/322, 340; 229/67.2; D19/90; 493/476; 312/183, 184; 281/43
See application file for complete search history.

(56) References Cited

U.S. PATENT DOCUMENTS

| | | | | |
|---|---|---|---|---|
| 546,647 | A * | 9/1895 | Barnes | 312/184 |
| 1,268,143 | A * | 6/1918 | Palmgren | 211/162 |
| 1,348,546 | A | 8/1920 | Cutler | |
| 1,524,348 | A * | 1/1925 | Field | 211/46 |
| 1,867,158 | A * | 7/1932 | Kline | 312/184 |
| 1,867,159 | A * | 7/1932 | Kline | 312/184 |
| 1,953,552 | A * | 4/1934 | Dequeker | 211/46 |
| 2,257,052 | A * | 9/1941 | Hanna | 211/46 |
| 2,325,317 | A | 9/1941 | Hanna | |
| 2,631,589 | A | 10/1944 | Zalkind | |
| 2,519,996 | A * | 8/1950 | Blake | 211/105.6 |

(Continued)

FOREIGN PATENT DOCUMENTS

| | | |
|---|---|---|
| EP | 1535752 A | 6/2005 |
| EP | 1607236 A | 12/2005 |

(Continued)

OTHER PUBLICATIONS

European Search Report for European patent application No. 08166326.2 issued on Mar. 6, 2009.

(Continued)

*Primary Examiner* — Joshua Rodden
(74) *Attorney, Agent, or Firm* — Hanley, Flight and Zimmerman, LLC

(57) ABSTRACT

A hanging file folder for mounting to a pair of spaced apart rails is disclosed. The file folder has a first and second rod with a pair of hook portions on opposing ends thereof for engaging the pair of spaced apart rails. The file folder body has first and second walls forming a pocket for holding materials therein, and is assembled such that the pocket is suspended between the first and second rods. At least one of the first and second rods includes a resilient structure for permitting at least one of the hook portions to move longitudinally and adjust an effective length of its rod for accommodating variances in the angle at which folders are mounted on the rails. The resilient structure may include a tension spring, for example. The hook portions may be movably mounted to the rod and may include the resilient mechanism.

31 Claims, 15 Drawing Sheets

(56) References Cited

U.S. PATENT DOCUMENTS

| | | | | | |
|---|---|---|---|---|---|
| 2,524,743 | A | * | 10/1950 | Wright | 224/313 |
| 2,605,769 | A | | 8/1952 | Lampel | |
| 2,608,420 | A | * | 8/1952 | Eck | 410/149 |
| 2,626,610 | A | | 1/1953 | McTavish | |
| 2,707,610 | A | * | 5/1955 | Fillion et al. | 248/215 |
| 2,765,793 | A | * | 10/1956 | Becker | 211/46 |
| 2,874,699 | A | | 2/1959 | Dunleavy | |
| 2,910,985 | A | | 11/1959 | Epstein | |
| 3,244,179 | A | | 4/1966 | Porteous | |
| 3,255,758 | A | | 6/1966 | Gauche | |
| 3,288,144 | A | | 11/1966 | Hyams | |
| 3,424,418 | A | * | 1/1969 | Freedman et al. | 248/304 |
| 3,524,688 | A | * | 8/1970 | Dean | 312/184 |
| 3,572,867 | A | * | 3/1971 | Cooper | 312/184 |
| 3,664,051 | A | | 5/1972 | Benichou | |
| 3,667,854 | A | * | 6/1972 | Jonas | 2/17 |
| 3,684,340 | A | | 8/1972 | Kirkorian | |
| 3,779,393 | A | * | 12/1973 | Grundell | 211/126.13 |
| 3,790,242 | A | * | 2/1974 | Sullivan | 312/184 |
| 3,801,175 | A | | 4/1974 | Guilie | |
| 3,850,488 | A | * | 11/1974 | Elias et al. | 312/184 |
| 3,863,828 | A | | 2/1975 | King | |
| 3,863,998 | A | * | 2/1975 | Grundell | 312/184 |
| 3,865,445 | A | * | 2/1975 | Dean et al. | 312/184 |
| 3,885,726 | A | | 5/1975 | Fridlund | |
| 3,957,321 | A | * | 5/1976 | Rose | 312/184 |
| 3,999,630 | A | * | 12/1976 | McPhee | 186/40 |
| 4,031,646 | A | | 6/1977 | De Nouel | |
| 4,053,057 | A | * | 10/1977 | Snowden | 211/126.13 |
| 4,056,296 | A | | 11/1977 | Hedstrom | |
| 4,103,606 | A | * | 8/1978 | Gitcho | 99/443 C |
| 4,105,268 | A | | 8/1978 | Elias | |
| 4,114,963 | A | * | 9/1978 | Menahem | 229/67.2 |
| 4,181,381 | A | | 1/1980 | St. Amand | |
| 4,209,925 | A | | 7/1980 | Brugmann | |
| 4,218,838 | A | | 8/1980 | Zippel | |
| 4,236,770 | A | | 12/1980 | Moore | |
| 4,256,425 | A | * | 3/1981 | Burgess et al. | 410/149 |
| 4,285,555 | A | | 8/1981 | Hedstrom | |
| 4,395,058 | A | * | 7/1983 | Terrell | 281/46 |
| 4,420,086 | A | * | 12/1983 | Bardes | 211/46 |
| 4,445,799 | A | * | 5/1984 | Wright et al. | 402/4 |
| 4,488,651 | A | * | 12/1984 | Bishop | 211/105.6 |
| 4,489,836 | A | * | 12/1984 | Terrell | 211/45 |
| 4,527,694 | A | | 7/1985 | Bolt | |
| 4,530,176 | A | | 7/1985 | Rejwan | |
| D285,217 | S | | 8/1986 | Smernoff | |
| 4,652,165 | A | * | 3/1987 | Bertesi et al. | 402/4 |
| 4,666,047 | A | | 5/1987 | Fletcher | |
| 4,703,982 | A | * | 11/1987 | Rock et al. | 312/330.1 |
| 4,842,435 | A | * | 6/1989 | Thomas et al. | 402/80 R |
| 4,870,767 | A | | 10/1989 | Davies | |
| 4,893,745 | A | | 1/1990 | Weber | |
| 4,950,096 | A | * | 8/1990 | Gilder | 402/4 |
| 4,988,006 | A | * | 1/1991 | Lundin | 211/46 |
| 5,042,769 | A | * | 8/1991 | Smed | 248/231.81 |
| 5,048,697 | A | | 9/1991 | Payne | |
| 5,052,646 | A | | 10/1991 | Hawes, Jr. | |
| 5,066,045 | A | | 11/1991 | Hawes, Jr. | |
| D322,284 | S | | 12/1991 | Whaley | |
| 5,082,404 | A | * | 1/1992 | Stewart et al. | 410/127 |
| 5,104,269 | A | * | 4/1992 | Hardison | 410/149 |
| 5,154,527 | A | * | 10/1992 | Blessing | 402/4 |
| 5,163,768 | A | * | 11/1992 | Salisbury et al. | 402/3 |
| 5,197,762 | A | * | 3/1993 | Abramov | 281/43 |
| 5,199,809 | A | * | 4/1993 | Semerjian | 402/4 |
| 5,255,798 | A | * | 10/1993 | Aaldenberg et al. | 211/46 |
| 5,261,636 | A | | 11/1993 | Hawes, Jr. | |
| 5,275,439 | A | | 1/1994 | Hawes, Jr. | |
| 5,295,622 | A | | 3/1994 | Lorber | |
| 5,328,259 | A | * | 7/1994 | Meriaux | 312/184 |
| 5,393,136 | A | * | 2/1995 | Grabowski et al. | 312/184 |
| 5,393,154 | A | * | 2/1995 | Hubbell | 402/4 |
| 5,405,020 | A | * | 4/1995 | Fotioo | 211/46 |
| 5,439,280 | A | | 8/1995 | Steinberg | |
| 5,515,980 | A | * | 5/1996 | Fotioo | 211/46 |
| 5,529,183 | A | * | 6/1996 | Nishikawa | 206/308.3 |
| 5,676,439 | A | | 10/1997 | Occhipinti | |
| 5,692,673 | A | | 12/1997 | De Safey | |
| 5,722,692 | A | * | 3/1998 | Abramov | 281/43 |
| 5,772,020 | A | * | 6/1998 | Hara | 206/308.3 |
| 5,899,626 | A | | 5/1999 | Hatano | |
| 5,941,450 | A | | 8/1999 | De Safey | |
| 5,942,293 | A | | 8/1999 | Occhipinti | |
| 5,944,423 | A | | 8/1999 | Rabin | |
| 5,993,099 | A | * | 11/1999 | Greenberg et al. | 402/4 |
| D417,697 | S | * | 12/1999 | Long et al. | D19/32 |
| 6,273,470 | B1 | | 8/2001 | Bullock | |
| 6,550,874 | B2 | * | 4/2003 | Walla et al. | 312/184 |
| 6,557,701 | B1 | | 5/2003 | Chen | |
| 6,588,060 | B1 | * | 7/2003 | Arentsen et al. | 16/87 R |
| 6,619,773 | B2 | | 9/2003 | Amsterdam | |
| 6,626,602 | B1 | * | 9/2003 | Yuen | 402/73 |
| 7,059,483 | B2 | * | 6/2006 | Scudder | 211/46 |
| D527,048 | S | * | 8/2006 | Scudder | D19/32 |
| 7,100,775 | B2 | * | 9/2006 | Yeh | 211/46 |
| 7,614,511 | B2 | * | 11/2009 | Konstant | 211/189 |
| 2003/0038565 | A1 | * | 2/2003 | Walla et al. | 312/184 |
| 2005/0199685 | A1 | | 9/2005 | Mark | |
| 2005/0205650 | A1 | | 9/2005 | Founds | |
| 2006/0097031 | A1 | | 5/2006 | Hoogland | |
| 2006/0124480 | A1 | | 6/2006 | Menard | |
| 2006/0226205 | A1 | | 10/2006 | O'Leary | |
| 2006/0242869 | A1 | | 11/2006 | Bunger | |
| 2008/0164302 | A1 | * | 7/2008 | Ho | 229/67.2 |

FOREIGN PATENT DOCUMENTS

| | | |
|---|---|---|
| FR | 2411092 A | 7/1979 |
| JP | 03-024997 | 2/1991 |

OTHER PUBLICATIONS

Chinese Application No. 200810170099.4, Office Action dated Jan. 30, 2011 (4 pages) & English Translation (7 pages).

Chinese Application No. 200810170099.4, Second Office Action dated Jul. 11, 2011 (4 pages) & English translation (4 pages).

Rejection Decision of Chinese Appl. No. 200810170099.4 dated Mar. 5, 2012 (4 pages Chinese with 4 pages of English Translation).

* cited by examiner

RESILIENT ROD FEATURE IN HANGING FILE FOLDER

BACKGROUND OF THE INVENTION

Field of Invention

The present invention is generally related to hanging file folders for mounting to a pair of spaced apart rails. More specifically, the present invention is related to hanging file folders with a structure for permitting adjustment of an effective length of its rod for accommodating variances when adjusting folders along spaced apart rails.

Background

Hanging file folders for holding papers and documents within a pocket in a filing cabinet with parallel, spaced apart rails are known in the art. However, some hanging file folders tend to have a limited amount of strength and may not provide ease for sliding the folders along the length of rail when holding documents.

For example, as the load within the pocket of a file folder increases, the hooks and rods for hanging the file folder require increased strength in order to provide suitable engagement with the rails of a filing cabinet or the like. The hooks and rods must also be designed to resist derailing of the file folder from the rails. For example, as the load increases, a file folder may be twisted or flexed and may lock onto the rail. Thus, file folders with increased strength and better engagement with the rails of a filing cabinet are beneficial.

Additionally, the spaced apart rails within cabinets may not be provided perfectly at the same distance. For example, rails within a filing cabinet may not be parallel or may not be spaced the same distance from one another in one drawer or cabinet as compared to another. Also, file folders generally hang perpendicular to the rails when at rest. FIG. 1 illustrates an overhead view of hanging file folders 4, 6 on a pair of spaced rails 2 in a drawer (not shown), for example. The file folder 4 hangs via hooks at points A and B in a perpendicular direction with respect to the rails. However, when the file folders are moved or adjusted along the rails, such as file folder 6, the file folder may be pushed at an angle with respect to the rails, as shown by folder 6 hanging by hooks at points C and D. A greater distance or span is thereby created between the hooks of the rod during adjustment and sit between the rails 2. The file folder (or the hooks of the rail of the file folder) may then tend to dislodge or come off of the rail entirely. For example, a file folder may have a "derailing angle" (i.e., the angle at which at least one of the hooks on a rod dislodges from the rail) of less than or equal to 15 degrees with respect to the spaced apart rails 2. Thus, it may be difficult to hang and adjust or slide file folders along such rails without having the folders come off the rails.

SUMMARY OF THE INVENTION

One aspect of the invention provides a hanging file folder for mounting to a pair of spaced apart rails. The hanging file folder includes a first rod with a pair of hook portions on opposing ends thereof for engaging the pair of spaced apart rails; a second rod with a pair of hook portions on opposing ends thereof for engaging the pair of spaced apart rails; and a file folder body with first and second walls forming a pocket for holding materials therein. The first wall of the file folder body is connected to the first rod, and the second wall of the file folder body is connected to the second rod, such that the pocket is suspended between the first and second rods. At least one of the first and second rods has a resilient structure for permitting at least one of the hook portions thereof to move longitudinally and adjust an effective length of its rod for accommodating variances in the angle at which folders are mounted on the rails and maintaining engagement therewith.

An aspect of the invention provides a method of forming a hanging file folder for mounting to a pair of spaced apart rails. The method includes forming a first rod with a pair of hook portions on opposing ends thereof; forming a second rod with a pair of hook portions on opposing ends thereof; attaching a first wall of a file folder body to the first rod; and attaching a second wall of the file folder body to the second rod. At least one of the rods includes a resilient structure for permitting at least one of the hook portions thereof to move longitudinally and adjust an effective length of its rod for accommodating variances in the angle at which the folders are mounted on the rails to maintain engagement therewith.

Another aspect of the invention includes a rod for mounting to a pair of spaced apart rails. The rod includes an elongated body for hanging an object therefrom. The body has a first end and a second end. A pair of hook portions are provided on opposing ends of the rod for engaging the pair of spaced apart rails, and a resilient structure is provided to permit at least one of the pair of hook portions to move longitudinally with respect to the elongated body. An effective length of the body is adjusted to accommodate variances in the angle at which the rod is mounted on the rails and to maintain engagement therewith.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 9A:
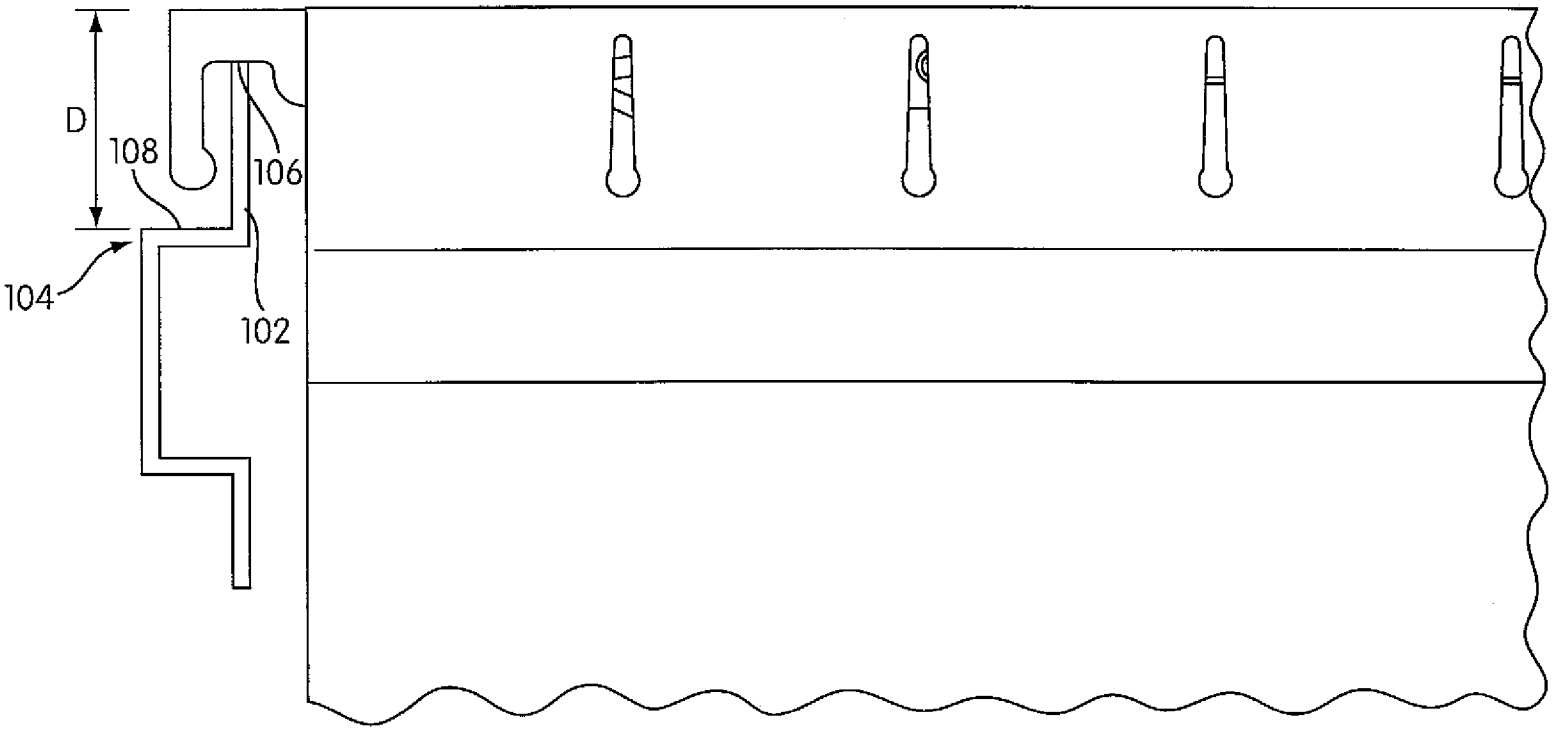
FIGS. 9*a*, 9*b* and 9*c* illustrate a perspective, front detailed perspective, and back detailed perspective view, respectively, of a rod with a reinforcing rib for use with the hook assembly in accordance with an embodiment of the present invention.
Figure 9B:
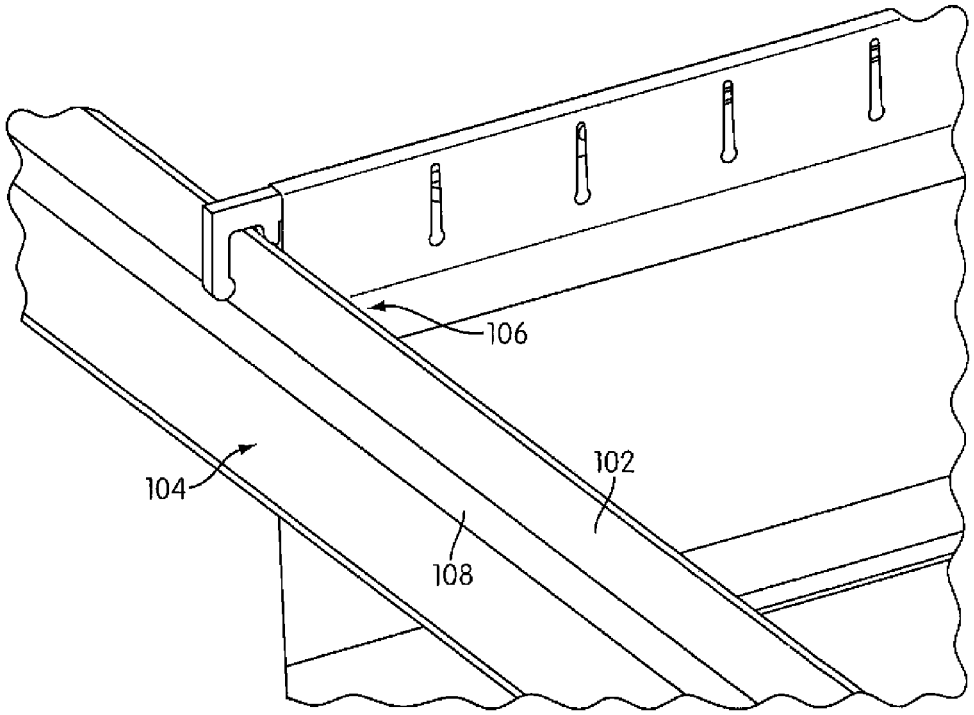
Figure 9C:
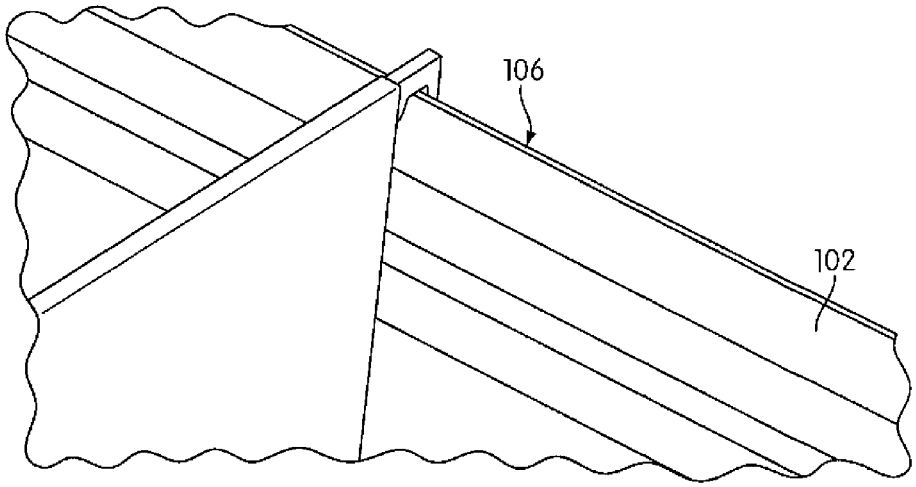

Generally, file folders may be laterally or perpendicularly hung on spaced apart rails provided within a drawer of a filing cabinet. As known in the art, file folders may be mounted on spaced apart rails running generally parallel with the length of the drawer or on spaced apart rails that may run parallel to the width of the drawer. For the herein disclosed embodiments, any type of rail system may be used. For example, as shown in FIGS. 9*a*-9*c*, a rail 102 with a reinforcing rib 104 may be used in a drawer (not shown) of a filing cabinet. The reinforcing rib 104 provides strength to the rail 102 so as to prevent bending of the body of the rail. In an embodiment, the reinforcing rib 104 may be formed uniformly as a single unit with the rail 102. As shown, the reinforcing rib 104 may be provided a distance D from the top 106 or contact point of a rail 102 to the top 108 of the reinforcing rib 104.

Figure 10:
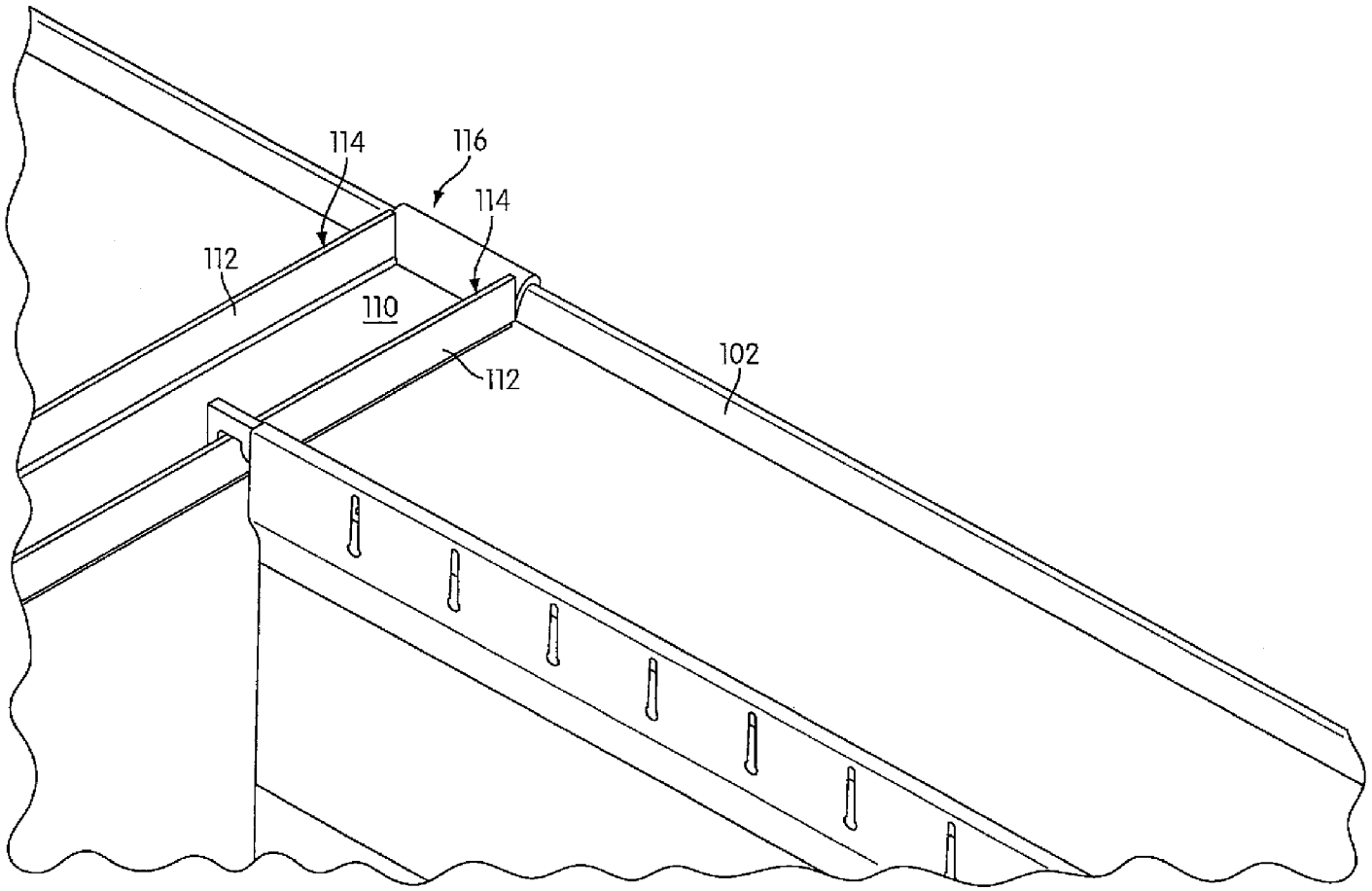
FIG. 10 illustrates an example of a channel with a rail that may be used in a file cabinet and with the hook assembly in accordance with an embodiment of the present invention.

As another example, FIG. 10 illustrates an embodiment wherein a channel 110 comprising a rail 112 may be used for hanging file folders. As shown, the channel 110 is shaped such that at least one extended rail 112 with a top 114 or contact surface is formed for receiving a hook of a rod of a file folder to hang thereon. In an embodiment, the channel 110 comprises a first attachment end 116 and a second attachment end (not shown) such that channel 110 may be mounted perpendicularly on the spaced apart rails (only one rail 102 of which is shown) of a file drawer. By attaching the ends of the channel 110 to the spaced apart rails in a drawer, file folders may be hung or mounted in an opposite or perpendicular direction (e.g., than originally intended).

Nonetheless, the above rails as shown in FIGS. 9*a*-9*b* and 10 are exemplary and should not be limited to those disclosed. The hanging file folder 10 and/or the hook and rod assembly 30 as described herein may be used with any type of rail system for mounting or hanging file folders, magazines or newspapers, or other objects as will be further described and should not be limited hereto.

Figure 2:
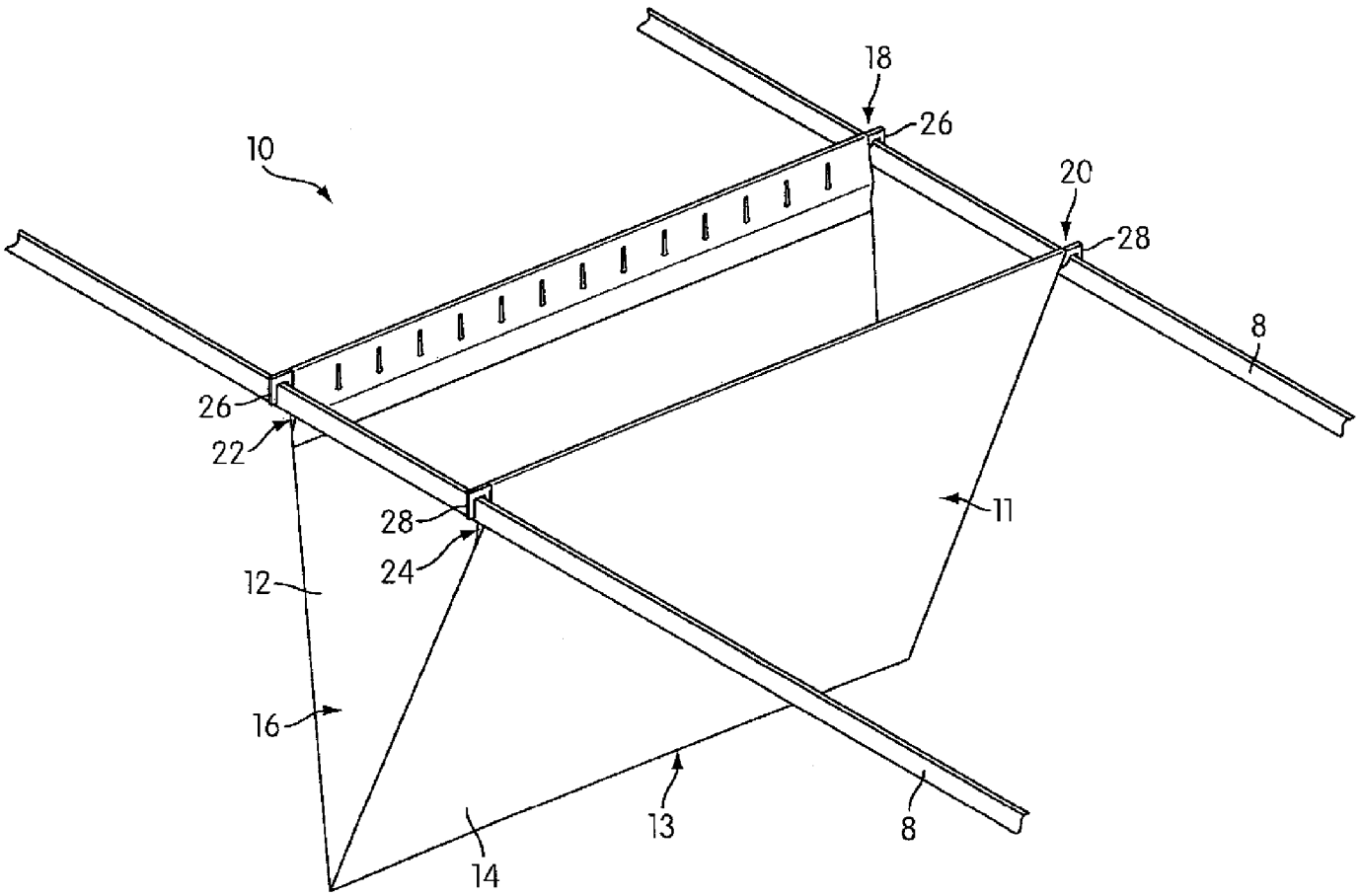
FIG. 2 illustrates a hanging file folder for mounting to a pair of spaced apart rails in accordance with an embodiment of the present invention.

FIG. 2 illustrates a hanging file folder 10 for mounting to a pair of spaced apart rails 8 in a drawer of a filing cabinet, for example. As shown, file folder 10 has a body 11 comprising a first wall 12 and second wall 14 that forms a pocket 16 for holding materials therein. The pocket 16 of the file folder 10 is designed to hold papers, documents and the like of various shapes and sizes, for example.

The first wall 12 of the body 11 is connected to a first rod 18 and the second wall 14 of the body 11 is connected to a second rod 20. A bottom end of first wall 12 is connected to a bottom end of the second wall 14 of the body 11 of the file folder 10 at 13, thus forming a pocket 16 therebetween. The pocket 16 of the folder 10 is designed such that it is suspended between the first and second rods 18, 20. The folder 10 may be connected to the rods 18, 20 in any number of ways. For example, in an embodiment, an open end 22 of the first wall 12 and an open end 24 of the second wall 14 may be designed such that they surround the first rod 18 and second rod 20, respectively (e.g., as shown in FIG. 2). The ends 22, 24 may comprise rod pockets designed to receive the rods 18, 20, for example. In an embodiment, the rods 18, 20 may be designed such that the ends 22, 24 of the first wall 12 and second wall 14 are captured within or connected to the rods 18, 20 (e.g., as further described with reference to FIG. 5*c*). Generally, the method of connecting the rods 18, 20 to the body 11 of the file folder 10 may be performed in any manner and therefore should not be limited to those as described herein.

FIG. 2 also shows the first rod 18 and second rod 20 with a pair of hook portions 26 and 28, respectively, on opposing ends thereof. The hook portions 26, 28 are provided to engage a pair of spaced apart rails 8 in a filing cabinet or the like. In accordance with an embodiment of the present invention, at least one of the first and second rods 18, 20 comprises a resilient structure for permitting at least one of the hook portions 26, 28 thereof to move longitudinally, thus adjusting an effective length of the rod body 18, 20. Additionally, when the file folders are moved or adjusted along the rails, the effective length of the rod body 18, 20 is adjusted to prevent the possibility of dislodging or coming off of the rail 8 when moving the file folder along the rail 8 (e.g., such as when opening the walls 12, 14 of the body 11 of the file folder 10 to access contents in the pocket 16 therein, or when moving a file folder 10 to access an additional folder). The use of the resilient structure with the rod and hook portions, as will be further described, thereby accommodates variances in the angle at which the folders are mounted on the rails, for example, and maintains engagement of the rod and hook portions with the rails. Additional features and advantages will become further evident below.

Figure 3:
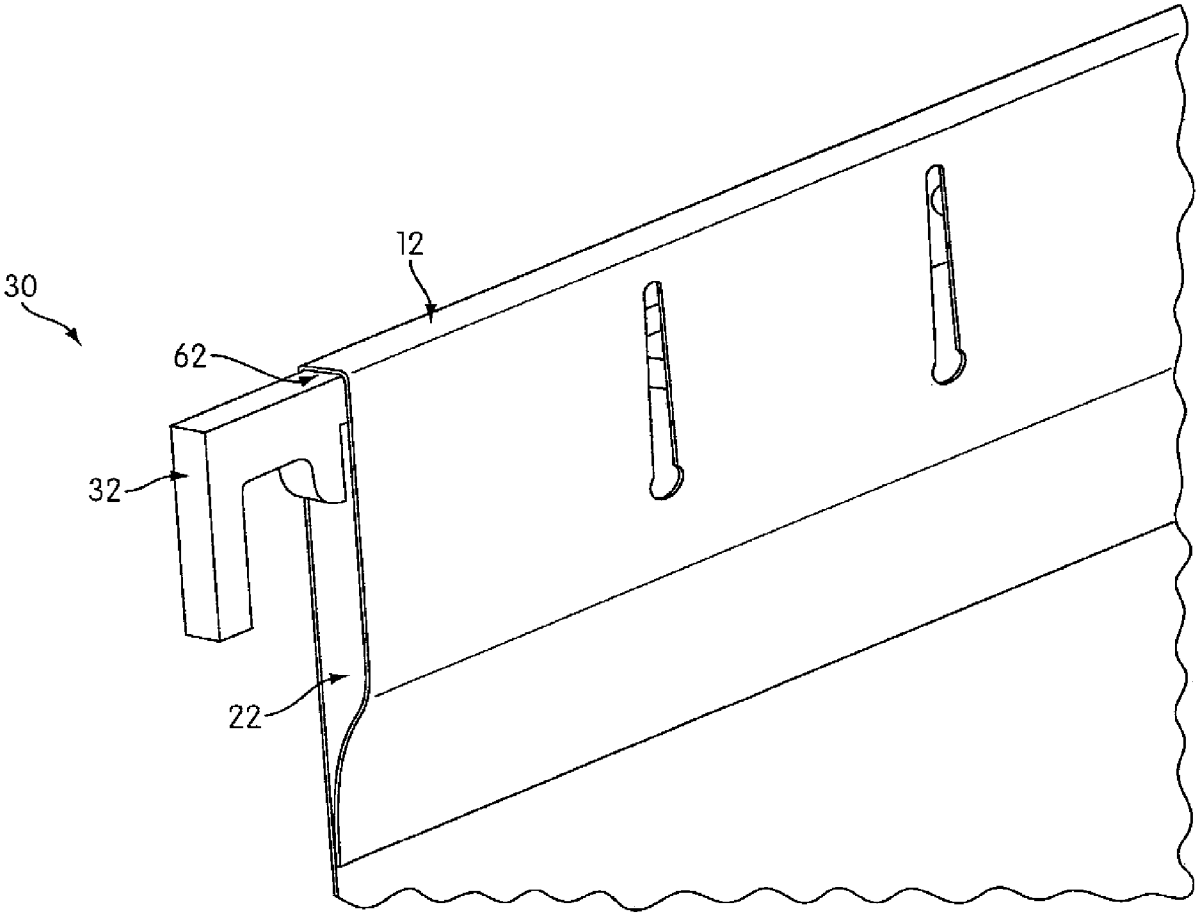
FIG. 3 illustrates a detailed view of an end of the hanging file folder of FIG. 2 with a hook and rod assembly in accordance with an embodiment of the present invention.

FIG. 3 illustrates a detailed view of the end 22 of first wall 12 of the hanging file folder 10 of FIG. 2 with a hook and rod assembly 30 in accordance with an embodiment of the present invention. The hook and rod assembly 30 is surrounded by end 22 (or provided through the rod pocket 22) of the first wall 12 of the file folder 10. The end 22 of first wall 12 is herein described for illustrative purposes only and should not be limiting, i.e., the hook and rod assembly 30 may be used with first wall 12, second wall 14, or both. In an embodiment, the hook and rod assembly 30 as herein described may be used on one or both opposing ends of the first and/or second rods 12, 14. In an embodiment, at least one hook of the pair of hook portions 26 and/or 28 may comprise a hook and rod assembly 30.

The hook and rod assembly 30 comprises a hook portion 32 and a rod portion 62. In an embodiment, hook and rod assembly 30 may be formed as a single unit. In an embodiment, at least one of the first and second hook portions 32 of the assembly 30 may be removably attached to the first and second rods 18, 20 or rod portions 62.

Figure 4A:
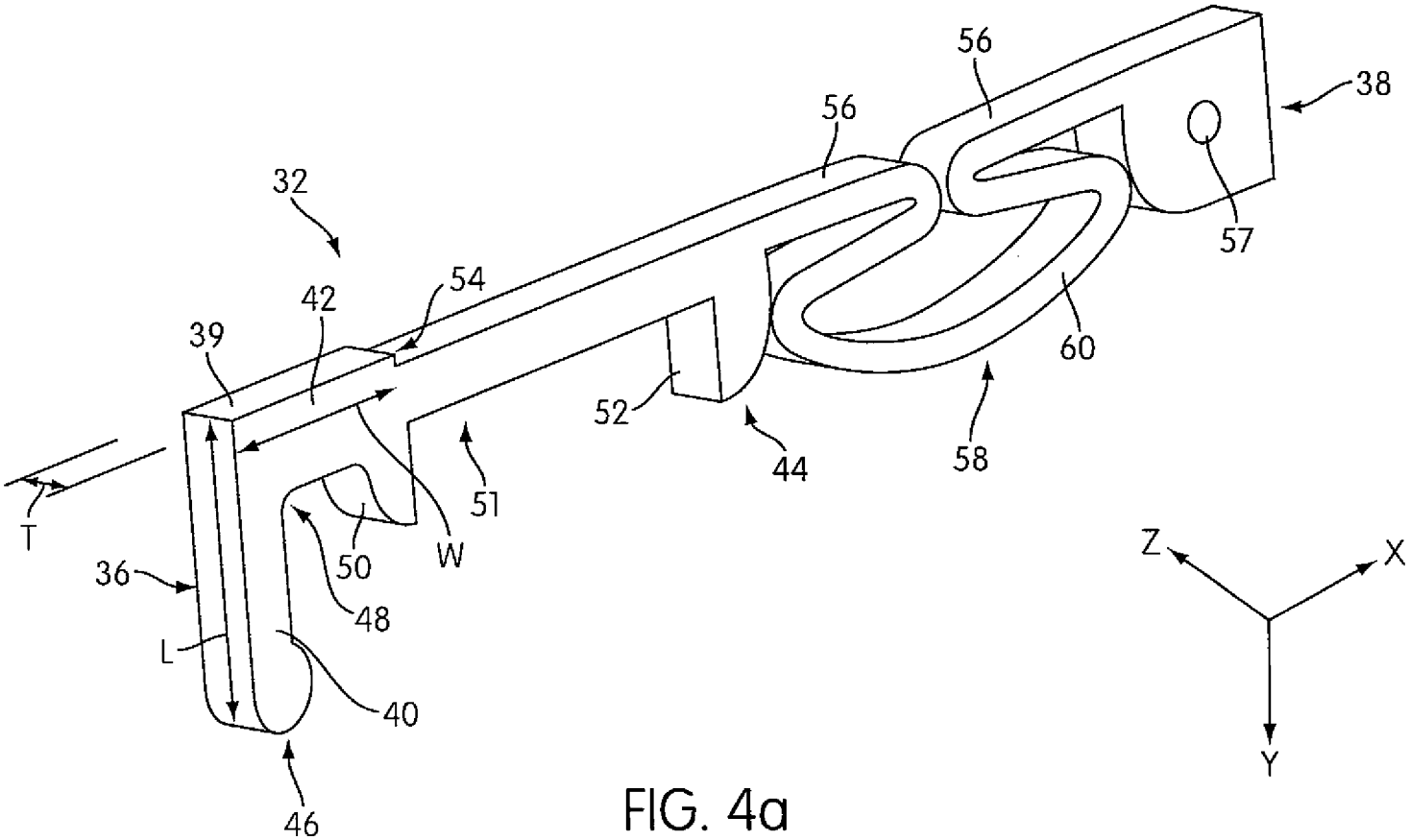
FIG. 4*a* illustrates the hook portion of FIG. 3 in accordance with an embodiment of the present invention.

FIG. 4*a* illustrates an example of the removably attached hook portion 32 of FIG. 3 in further detail. As shown and will be further described, in an embodiment, the hook portion 32 may be moveably mounted with respect to rod portion 62. Hook portion 32 comprises a proximal end 36 and a distal end 38. Proximal end 36 comprises a hook 39 for surrounding a rail 8 (as shown in FIG. 2).

In an embodiment, hook 39 comprises an elongated portion 40 and a longitudinal portion 42. Elongated portion 40 of hook 39 also comprises an end portion 46. In an embodiment, elongated portion 40 may comprise a bulbous end portion 46, as shown in FIG. 4*a*. For example, bulbous portion 46 may be provided near the end of the hook 39 in order to aid in keeping the hook portion 32 of the hook and rod assembly 30 on a rail. The elongated portion 40 transitions into the longitudinal portion 42 via a curved or radiused portion 48. The curved portion 48 is provided along the underside of the longitudinal portion 42 of the hook portion 32. The curved portion 48 is formed such that it comes into contact with a rail for hanging the file folder 10. In an embodiment, the curved portion 48 comprises a variable radius for preventing excessive contact with the rail.

Longitudinal portion 42 extends into a hook body 44. The end of longitudinal portion 42 transitions into hook body 44 and includes an extension portion 50 and an abutment portion 54. Extension portion 50 is formed such that it comes into contact with an opposite (i.e., inner) side of a rail when hanging file folder 10. In an embodiment, as shown in FIG. 4*a*, extension portion 50 may comprise a rounded surface or variable radius for preventing excessive contact with the rail. Abutment portion 54 is provided such that it sits adjacently against an edge of the rod portion 62 when assembled (as will be described with reference to FIG. 4*c*).

The hook body 44 may also comprise a limiting portion 52. In an embodiment, the limiting portion 52 is provided as a stop for limiting the amount of longitudinal movement of the hook portion 32 with respect to rod portion 62. The area 51 between the extension portion 50 and limiting portion 52 provides a bearing surface for the hook portion 32 to move or slide on a a part of the rod, as will be discussed in greater detail below. Thus, limiting portion 52 limits the length the bearing surface 51 may move with respect to the rod 62.

Figure 11A:
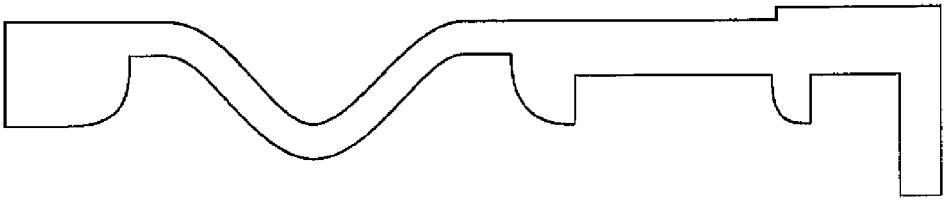
FIGS. 11*a*-11*c* illustrate examples of alternate designs for a resilient mechanism that may be used with a hook and rod assembly in accordance with an embodiment.
Figure 11B:
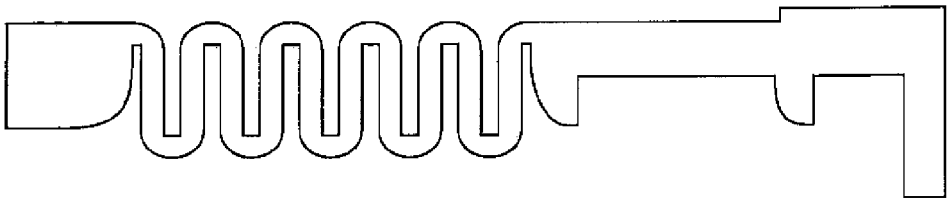
Figure 11C:
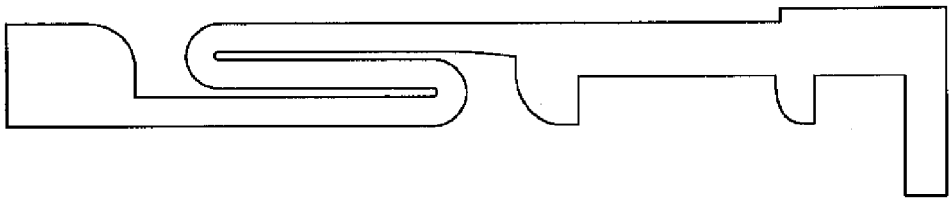

As previously noted, at least one of the first and second rods may have at least one hook portions thereof moveably mounted to the rod portion 62. In an embodiment, the resilient structure is constructed and arranged between the rod 62 and the hook 39 near the distal end 38 of hook portion 32. In an embodiment, the hook body 44 of hook portion 32 comprises a resilient structure 58 as shown in FIG. 4*a*. In an embodiment, resilient structure 58 comprises a tension spring. As shown, in an embodiment, the resilient structure 58 or spring may comprise a rounded shape, much like the Greek letter Omega, with first and second legs 56 joined at 60. In an embodiment, resilient structure may comprise a "U"-shape, "V"-shape, "W"-shape, or any other known shapes for providing resiliency where angular deflection of at least one member may occur. FIGS. 11*a*-11*c* illustrate examples of alternate designs for a resilient mechanism that may be used with a hook and rod assembly in accordance with an embodiment. For example, as noted above, FIG. 11*a* illustrates an example of a resilient structure comprising a "V"-shape. FIG. 11*b* illustrates an example of resilient structure comprising a "snake"-like shape comprising a plurality of curves. FIG. 11*c* illustrates an example of a resilient structure comprising an "S"-shape. Likewise, the resilient structure 58 may also comprise a member made from a resilient material permitting elongation thereof.

In an embodiment, the resilient structure 58 may be formed integrally as one continuous piece with the hook portion 32. For example, in an embodiment, the hook portion 32 is formed through a stamping, punching, or molding process. In an embodiment, hook portion 32 may be formed of nylon. The hook portion 32 may be of any known length. The elongated portion 40 of the hook 39 of hook portion 32 may be designed to extend below the height of a rail, for example. In an embodiment, the length (e.g., length L of the elongated portion 40 from the top of longitudinal portion 42 to the end portion 46 along Y-axis, as indicated in FIG. 4*a*) of the hook portions 32 may comprise a length L designed to accommodate the distance D from the top 106 of a rail 102 in a file cabinet to the top 108 of a reinforcing rib 104 of the rail 102, as shown in FIGS. 9*a* and 9*b*. In an embodiment, the length L and width W (e.g., length of longitudinal portion 42 from the abutment portion 54 to the elongated portion 40 along the X-axis, as indicated in FIG. 4*a*) of the hook portion 32 may be defined by a window comprising the distance from a rail to the inside of a file cabinet. In an embodiment, the window may comprise approximately 9.6 millimeters (mm) by approximately 11.5 millimeters (mm).

In an embodiment, hook portion 32 may comprise a depth or thickness T of 2 millimeters (mm) and a length L of 9.6 millimeters (mm). In an embodiment, the hook portion 32 may comprise a thickness T to minimize the impact of the drawer space used by the file folder 10. That is, the thickness T may be adjusted such that a drawer may hold more file folders based on the depth or thickness of the hook. For example, a drawer maybe designed to hold eighty (80) file folders. However, by adjusting the depth or thickness T of the hook in the Z-direction (i.e., along Z-axis, as indicated in FIG. 4*a*), the same drawer may hold one hundred (100) file folders.

The distance of the bearing surface 51 is set to limit the extension of the resilient structure 58. For example, the distance of the bearing surface 51 may be determined by a distance needed to extend the file folder. In an embodiment, the distance of the bearing surface 51 may also be determined by the amount of flexure or "flex" that would cause the resilient structure 58 to permanently yield (i.e. experience plastic deformation). In an embodiment, the amount of flex may be determined or affected by the material used to form resilient structure 58. For example, a material such as nylon may bend more than a high density polyethylene (HDPE) before yielding. In an embodiment, resilient structure 58 may comprise the material of which the hook portion 32 comprises. In an embodiment, the resilient structure 58 may comprise nylon or HDPE, for example. In an embodiment, the resilient structure 58 may comprise a spring steel.

The distal end 38 of hook portion 32 may also comprise an attachment feature such as a mounting portion 56. FIG. 4*a* illustrates a mounting portion 57 (e.g., an opening) on the distal end 38 of the hook body 44. The mounting portion 57 is designed to mount or hold the hook portion 32 within the rod portion 62. In an embodiment, mounting portion 57 of hook portion 32 may comprise a female portion and rod 62 may comprise a male portion, wherein when the hook portion(s) 32 are connected to the opposing ends of the rod 62, the male and female portions mate to secure the hook portion(s) 32 to the rod 62. In an embodiment, the mounting portion 57 may comprise a hole or opening for receiving an extended portion or pin located on the rod portion 62, for example, as shown in the Figures. The mounting portion 57 assists in keeping the hook portion 32 within the rod portion 62 and may also assist in limiting the amount of movement of the hook portion 32 with respect to the rod portion 62.

Figure 4B:
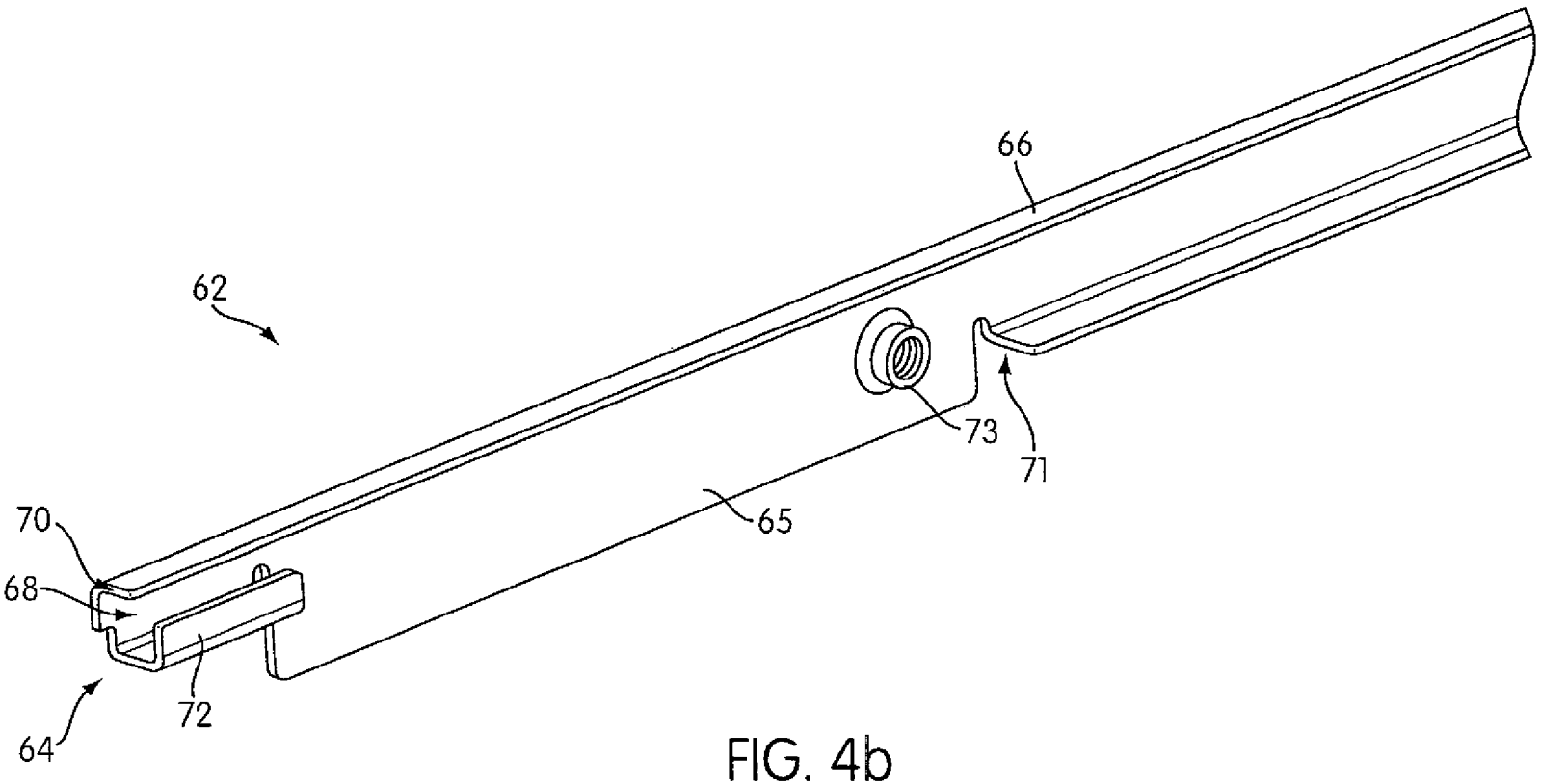
FIG. 4*b* illustrates a rod for use with the hanging file folder of FIG. 2 in accordance with an embodiment of the present invention.

FIG. 4*b* illustrates the rod portion 62 in accordance with an embodiment of the present invention. FIG. 4*b* illustrates a proximal end 64 of the rod 62 and elongated body 66. In an embodiment, the elongated body 66 of rod 62 may comprise a channel or a slot 68 for receiving hook portions 32 therein. As shown, the channel or slot 68 may comprise a "U"-shape at the proximal end 64 of the rod 66, but should not be limited to such.

The body 66 of rod 62 may be roll formed, for example. In an embodiment, the proximal end 64 of the body 66 comprises a channel 68 and a receiving portion 65. As shown, receiving portion 65 may be a section that is substantially flat. Rod 62 is designed to receive movably mounted hook portion 32 within its slot 68 and receiving portion 65, for example. Rod 62 comprises an end 70 for abutment with the abutment portion 54 of the hook portion 32. Rod 62 also comprises an end 71 for abutment with the distal end 38 of the hook portion 32.

The rod 62 may also comprise attachment features such as a rounded edge 72 and a male portion or extended mounting portion or pin 73. Limiting edge 72 and mounting portion 73 may be provided near the proximal end 64 of the rod 62, for example. Limiting edge 72 is designed to cooperate with the extension portion 50, bearing surface 51, and limiting portion 52 of the hook portion 32. The limiting edge 72 also provides an area for the bearing surface 51 to slide thereon along the rod 62, as shown in FIG. 4*c*.

The extended mounting portion or pin 73 may be formed with receiving portion 65 or in elongated body 66, for example. The extended mounting portion or pin 73 within the body 66 may be designed to cooperate with the female mounting portion or opening 57 of the hook portion 32. For example, when hook portion(s) 32 are connected to the first and second ends of a rod(s) 62, the opening 57 of the hook portion(s) 32 mate with the male, extended mounting portions 73 of the rod 62 to secure the hook portions 32 to the rod 62. In an embodiment, the extended mounting portion or pin 73 may comprise any number of shapes or designs designed to correspond with the shape of the mounting portion 57 of the hook 32.

Figure 4C:
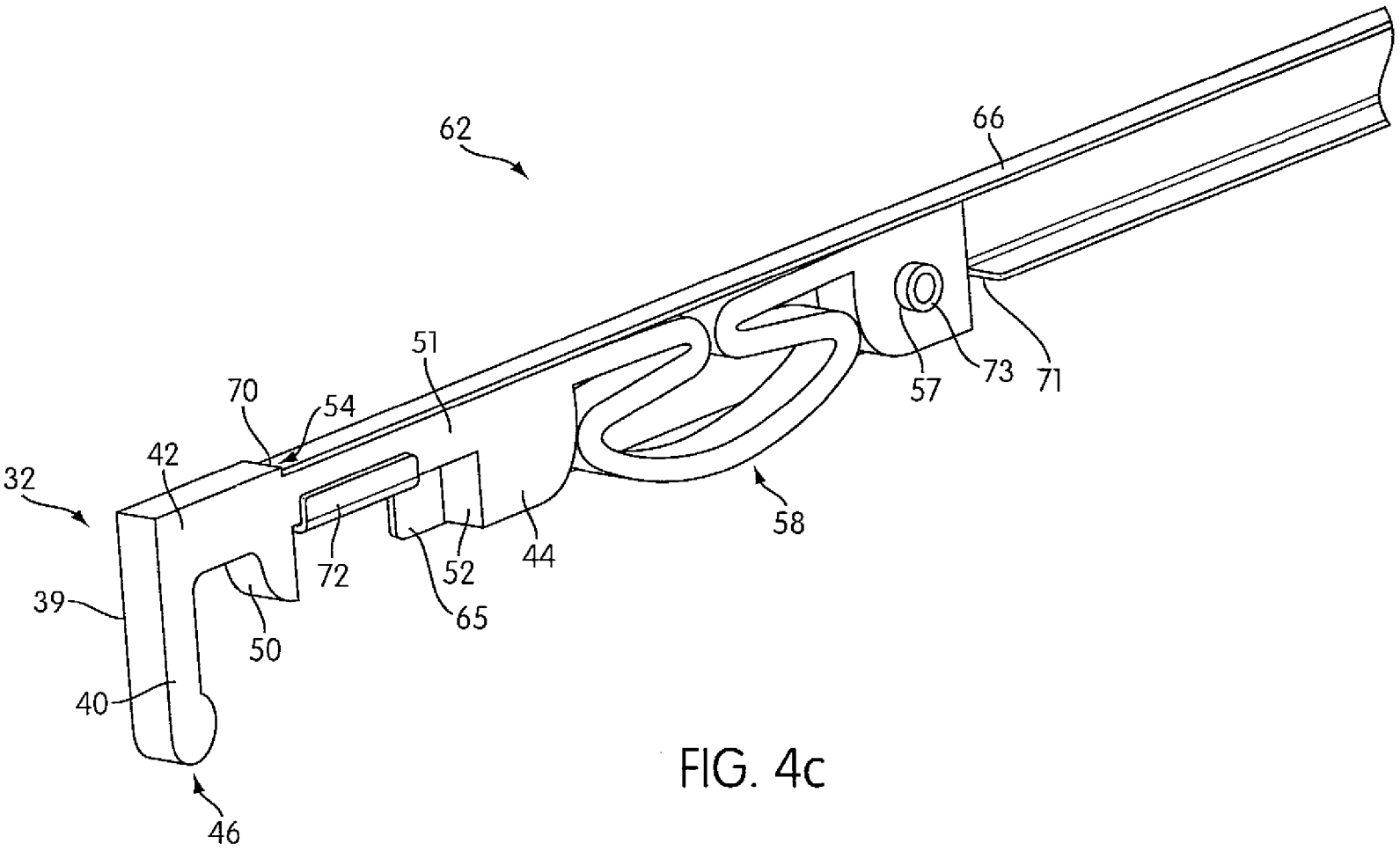
FIG. 4*c* illustrates an assembly of the hook portion and rod of FIGS. 4*a*-4*b* for use with the hanging file folder of FIG. 2 in accordance with an embodiment of the present invention.

FIG. 4*c* illustrates the final hook and rod assembly 30 of the hook portion 32 and rod 62 of FIGS. 4*a*-4*b* for use with the hanging file folder 10 of FIG. 2. (The manufacturing assembly process is further described with respect to FIGS. 8*a*-8*d* below). As shown, the hook portion 32 is mounted within the roll formed body 66 of the rod 62. The attachment features of the hook 32 (e.g., abutment portion 54 and mounting portion 57) and of the rod 62 (e.g., end 70, limiting edge 72, receiving portion 65, edge 71, and the mounting portion 73) mate together to hold the hook portion 32 within the rod 62. The attachment and insertion of the hook portion 32 into the rod 62 allows for adjustment of the effective length of the rod by permitting the hook portion 32 to move longitudinally with respect to the rod 62. The resilient structure 58 allows for the hook portion 32 to spring back into the rod body 66 when removed from a rail of a file drawer, for example.

When the hook portion 32 is moved longitudinally within the rod 62, the limiting portion 52 and limiting edge 72 limit the amount or length of extension of the hook portion 32.

Figure 5A:
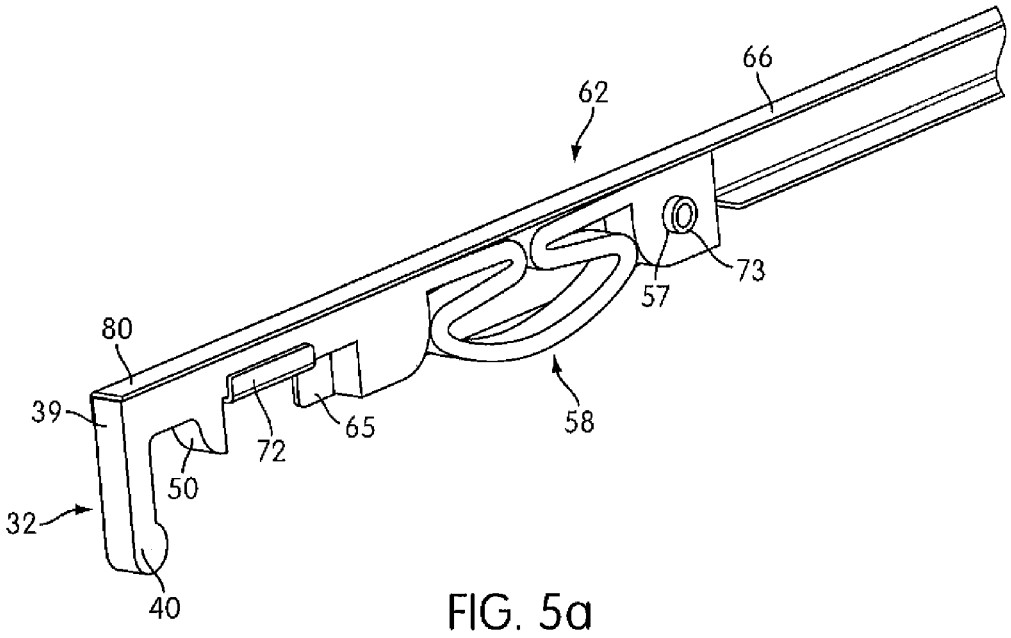
FIGS. 5*a* and 5*b* illustrate a front and back view of an extension that may be added to the assembly of FIG. 4*c* in accordance with an embodiment of the present invention.
Figure 5B:
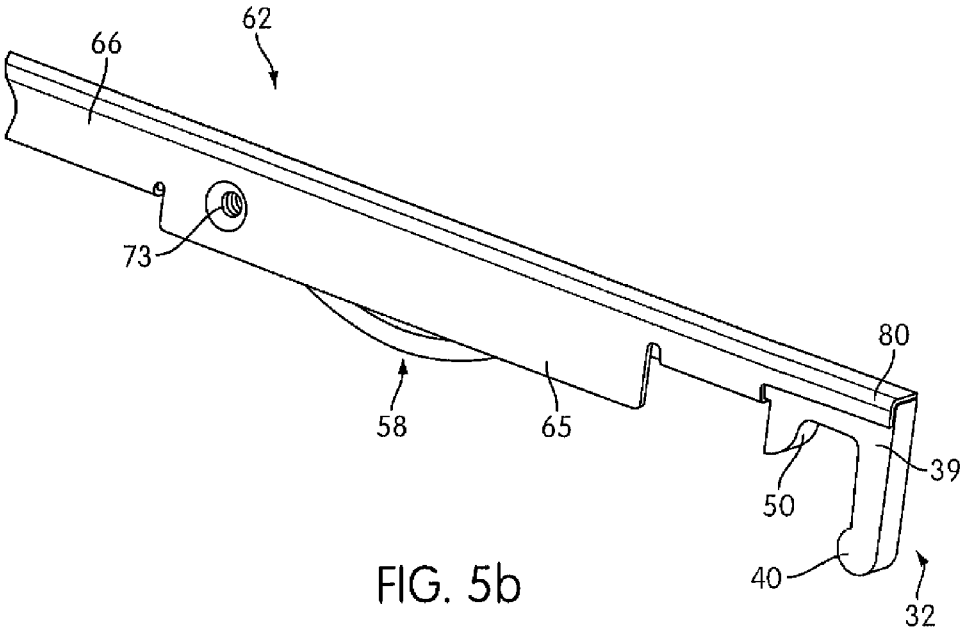
Figure 6A:
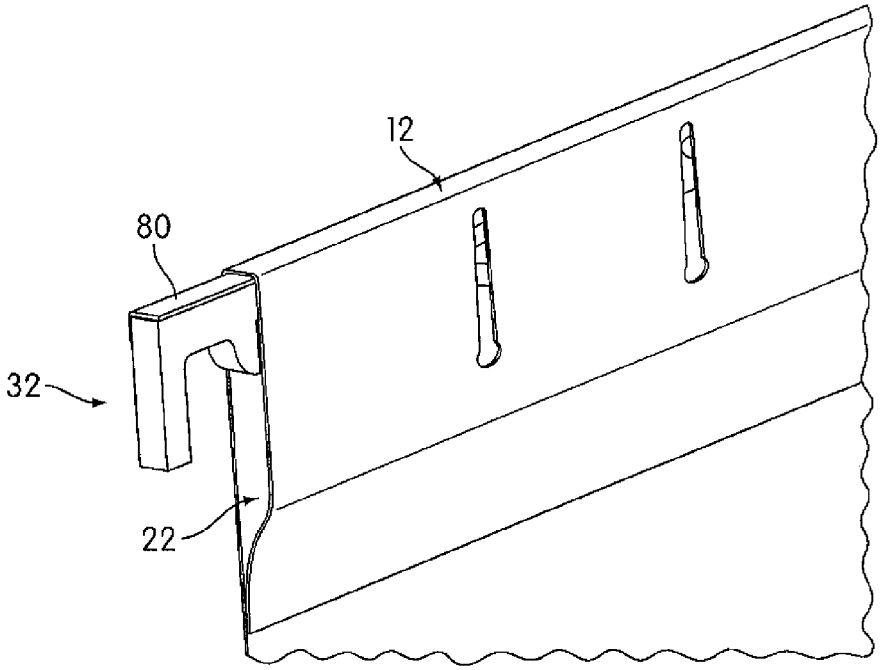
FIGS. 6*a* and 6*b* illustrate a front and back view of the extension of FIGS. 5*a* and 5*b* in use with a hanging file folder such as the hanging file folder of FIG. 2 in accordance with an embodiment of the present invention.
Figure 6B:
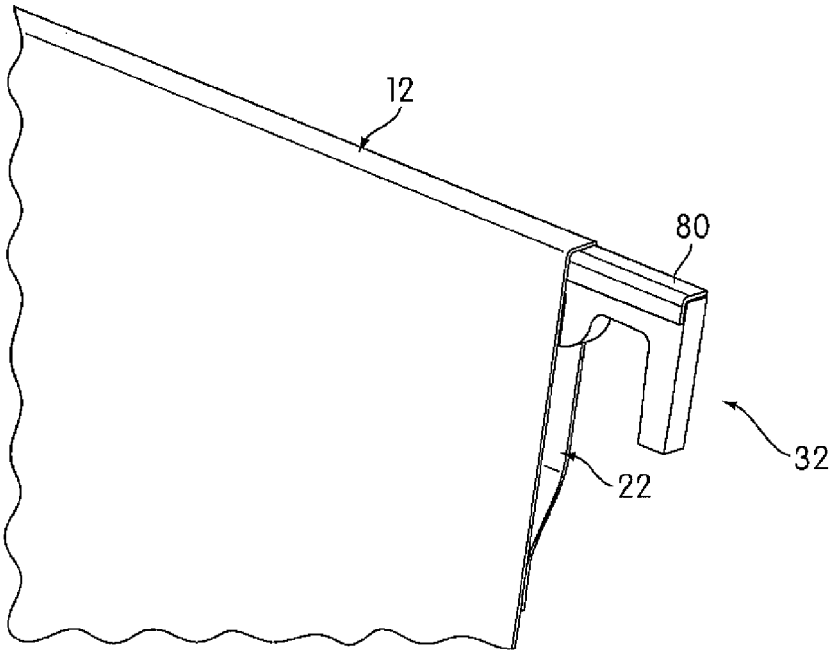

FIGS. 5*a* and 5*b* illustrate an extension 80 that may be added to the assembly of FIG. 4*c* in accordance with an embodiment of the present invention. For example, extension 80 may comprise a separate piece (not shown) to be added to the elongated body 66 of the rod portion 62, or may be formed with elongated body 66 uniformly (as shown in FIGS. 5*a* and 5*b*). The extension 80 may be designed to cover part of the hook portion 32 to enhance the appearance of the length of the rod 62, for example. For example, as shown, the extension 80 may be formed to sit over longitudinal portion 42 of the hook portion 32. The extension 80 may also enhance the strength of the hook portions 32. FIGS. 6*a* and 6*b* illustrate a front and back view of the extension 80 in use with a hanging file folder 10 in accordance with an embodiment of the present invention. As shown, the extension 80 may be visible outside of the body 11 of the file folder.

Figure 7A:
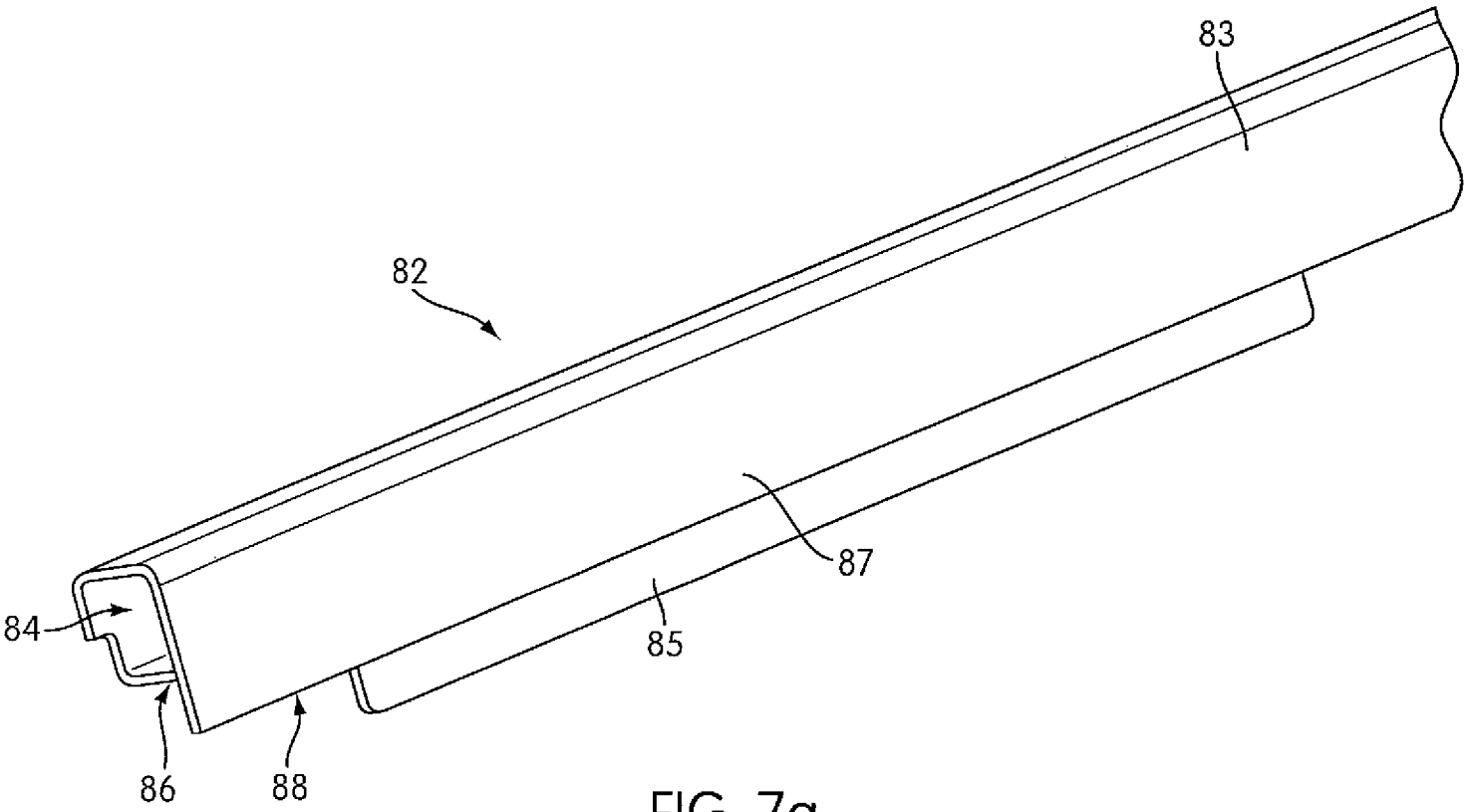
FIGS. 7*a* and 7*b* illustrate an alternate rod for use with the hook portion of FIG. 4 in accordance with an embodiment of the present invention.
Figure 7B:
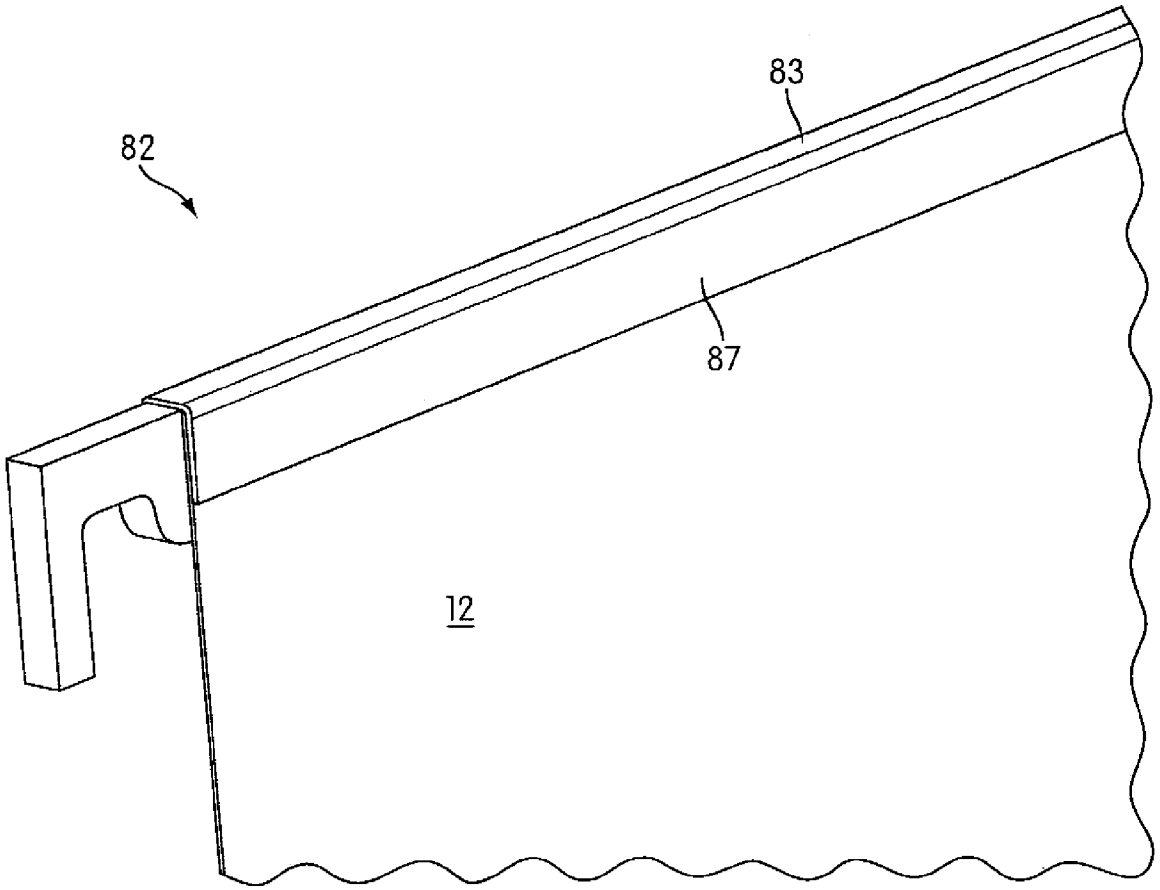

FIGS. 7*a* and 7*b* illustrate an alternate rod 82 for use with the hook portion(s) 32 of FIG. 3 in accordance with an embodiment of the present invention. Rod 82 is designed such that a channel 84 formed within the elongated body 83 that may capture a first or second wall 12, 14 of the body 11 of the file folder 10. For example, the first wall 12 may be inserted into a slot 88 formed by the receiving portion 85 and extension wall 87 formed in elongated body 83. A limiting portion 72, such as shown in FIG. 4*a*, may be formed with an edge 86 thereon for assisting in holding a wall 12, 14 of the folder 10. The wall 12 may be crimped in the slot 88 between the receiving portion 85, edge 86, and wall 87 of the elongate body 83 of the rod 82 as shown in FIG. 7*b*.

In an embodiment, the rod 62 may be formed from 0.4 millimeter (mm) steel material. In an embodiment, the rod may be formed from metal. For example, the rod may be formed from steel, brass, aluminum, or titanium. In an embodiment, the rod may be formed using a roll forming, stamping, extruding and/or punching, or other known manufacturing processes. In an embodiment, hook portion 32 may be formed from a resilient material. In an embodiment, the rod and/or hook portion may be formed from plastic. In an embodiment, the parts of the assembly 30 may be formed via extrusion process.

The assembly process may be performed on a conveyor system, for example. The rod portion 62 and its features (e.g., channel 68, limiting portion 72) may be formed through processes such as roll forming, stamping, extruding and/or punching. The hook portions 32 may be formed by stamping, punching, injection molding, or extrusion processes, for example. FIGS. 8*a*-8*d* illustrate a method of manufacturing and assembly for a hook portion 32 and a rod 62 of a hook and rod assembly such as shown in FIGS. 3-7*b* in accordance with an embodiment of the present invention.

In an embodiment, the assembly process is designed based on speed. For example, due to high volumes, assembly of the features may meet or exceed rates of 200 parts per minute. In order to meet such a criteria, the hook portions 32 are sorted and positioned individually in a hopper or fixture 92. The fixture 92 is designed to hold a plurality of hook portions 32 until the rod is in place for assembly.

Figure 8B:
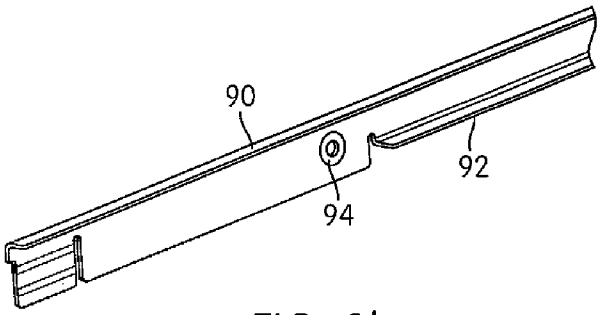
FIG. 8*a*-8*d* illustrate a method of assembly for a hook and rod assembly such as shown in FIGS. 3 and 4*a*-4*c* in accordance with an embodiment of the present invention.
Figure 8A:
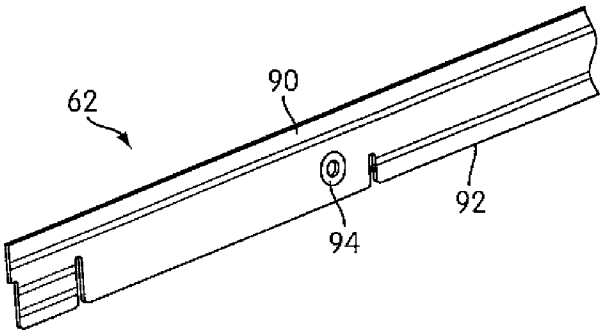
Figure 8D:
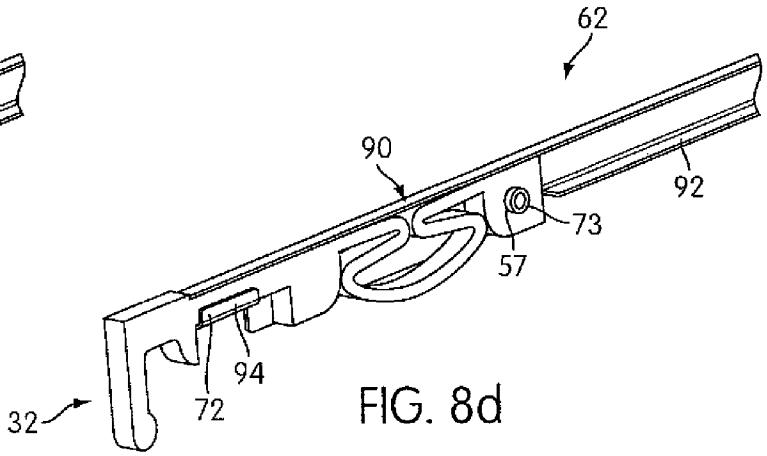
Figure 8C:
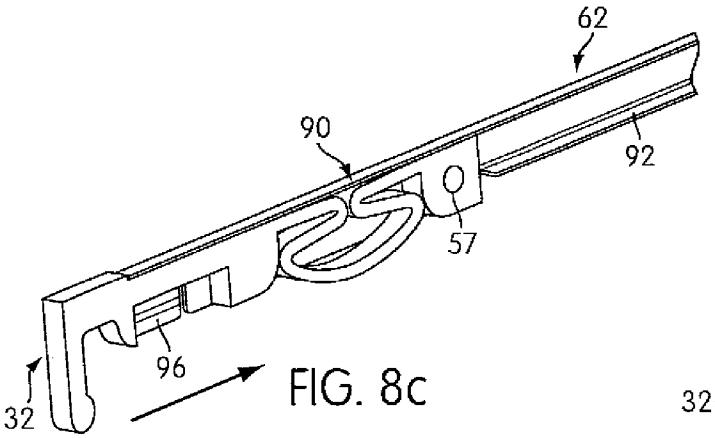

The manufacturing and assembly of the hook and rod assembly 30 may comprise the following steps: the rod is formed in the form of a substantially flat piece of material, as shown in FIG. 8*a*, through a stamping process, for example. The body of the rod 66, including the mounting portion shown as element 94, is substantially flat. At least a top edge 90 and bottom edge 92 are then roll formed to form the structure as shown in FIG. 8*b*. After roll forming (or otherwise forming) the rod 62, the rod 62 may be aligned with a fixture comprising a plurality of hook portions 32. The hook portions 32 may be aligned and positioned within the body 66 of the rod 62 as shown in FIG. 8*c*. For example, actuators (not shown) may be used to push a single hook portion 32 out of the fixture 92 and into the body 66 of the rod 62, as indicated by an arrow.

The rod 62 may then be deflected, stamped, or otherwise formed around the hook portion 32 so as to form attachment features for maintaining the hook portion 32 and rod 62 in a mating relationship. For example, in an embodiment, to facilitate assembly, the attachment features (i.e., limiting edge 72, mounting portion 73) of rod portion 62 may be formed from flat portions 96, 94, respectively, during the assembly as shown by FIGS. 8*c*-8*d*. After insertion and positioning of the hook portion 32 into the elongated body 66, the attachment features may be stamped to hold the hook portion 32 therein and thus complete the hook and rod as shown in FIG. 8*d*. In an embodiment, the method of attaching the hook portion to the rod may be automated. In an embodiment, mounting portions (such as a male portion (e.g., pin 73) or female portion (e.g., mounting portion 56)) may be formed on the hook portion and/or rod during the manufacturing/assembly process. In an embodiment, adhesive may be used to assist in fixing the hook portion and rod components together as well.

The above described manufacturing and assembly method enables one to fasten or secure the hook portion 32 in the assembly 30 in one motion, thus aiding in the assembly time needed to run this process at a high rate. However, the above noted materials and processes are merely exemplary and should not be limiting, and the rod and hook portions may be assembled using any number of materials and/or processes.

Although the hook and rod assembly 30 is herein described with hook portion 32 removably mounted to rod portion 62, as noted above, in an embodiment, hook and rod assembly 30 may be formed as a single unit. For example, hook and rod assembly 30 may be formed from materials (e.g., such as steel and/or spring steel) that allow for a single or uniform body. In an embodiment, the hook portion 32 may be attached to the rod 62 using known processes for unifying the assembly 30. For example, the hook portion 32 may be formed of spring steel which is attached to a rod 62 of steel.

Also, in an embodiment, the hook and rod assembly 30 may be used alone for mounting to a pair of spaced apart rails. That is, hook and rod assembly 30 need not be used in pairs, as shown with a file folder 10. For example, when hanging a magazine, newspaper, or other object, only one rail may be needed. Thus, the hook and rod assembly 30 may comprise a single rod with a pair of hooks portions, as described above, for hanging on spaced apart rails.

The hook and rod assembly 30 as herein described improves the quality of a file folder. The assembly 30 provides greater strength for holding documents and file therein on rails in a filing cabinet. For example, the roll-forming of the rod portion 62 increases the amount of weight that maybe held by the file folder 10. The rod portion 62 also resists bending and twisting and thus resists deforming and buckling of the rod 62 under a load. The extension portion 80 also increases the strength of the overall assembly.

Also, the assembly 30 provides better engagement with rails 8 by providing minimal contact with the rail 8. By ensuring that only couple of points of the hook come in contact with the rail (e.g., by using a curved portion 48 with a changing radius), the file folder 10 or hook and rod assembly 30 may easily move with respect to the rail, such as when twisted with respect to the rails.

Figure 1:
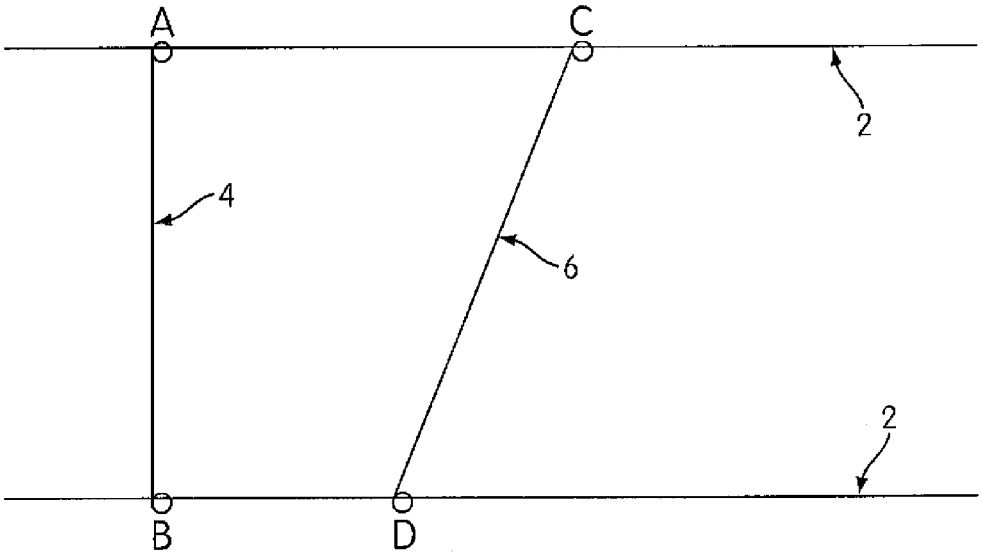
FIG. 1 illustrates an overhead view of file folders mounted or hanging on a pair of spaced apart rails.

The assembly is also designed to resist derailing or binding of the file folder. The file folder 10 or assembly 30 may be twisted to a maximum gripping angle while in contact with the rail. Additionally, the assembly 30 also increases the ease of sliding the hook and rod assembly 30 of the file folder along the length of a rail. When the file folders or the assembly 30 are moved or adjusted along the rails, such as shown by file folder 6 of FIG. 1, the assembly 30 may be pushed at an angle with respect to the rails, thereby creating a greater distance or span between the hooks of the rod during adjustment and sit between the rails. The design of the hook and rod assembly 30 increases the derailing angle at which at least one of the hooks on a rod dislodges from the rail. More specifically, the derailing angle of the hook and rod assembly 30 may be increased to at least 29 degrees.

The assembly 30 also allows for one to hang a file folder 10, magazine, or other object along spaced apart rails within cabinets which may not be provided at the same distance, such as along rails within a filing cabinet that may not be parallel or that may not be spaced the same distance from one another in one drawer or cabinet.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A hanging file folder for mounting to a pair of spaced apart rails, comprising:

a first rod with a pair of hook portions on opposing ends thereof for engaging the pair of spaced apart rails;

a second rod with a pair of hook portions on opposing ends thereof for engaging the pair of spaced apart rails;

a file folder body comprising first and second walls forming a pocket for holding materials therein;

the first wall of the file folder body being connected to the first rod and the second wall of the file folder body being connected to the second rod such that the pocket is suspended between the first and second rods; and wherein at least one of the first and second rods comprises a resilient structure for permitting at least one of the hook portions thereof to move longitudinally and dynamically adjust an effective length of its rod as the file folder and the rods are moved along the rails for accommodating variances in an angle at which the folder is mounted on the rails and a distance between the rails and maintaining engagement therewith.

2. A hanging file folder according to claim 1, wherein the at least one of the first and second rods has at least one hook portion thereof moveably mounted to the rod.

3. A hanging file folder according to claim 2, wherein the resilient structure is constructed and arranged between the rod and the at least one moveably mounted hook portion.

4. A hanging file folder according to claim 3, wherein the moveably mounted hook portion includes a mounting portion fixed along a length of the rod.

5. A hanging file folder according to claim 2, wherein the moveably mounted hook portion comprises the resilient structure.

6. A hanging file folder according claim 1, wherein the at least one hook portion comprises the resilient structure.

7. A hanging file folder according claim 1, wherein the resilient structure is a tension spring.

8. A hanging file folder according claim 2, wherein the at least one hook portion is removably attached to the at least one of the first and second rods.

9. A hanging file folder according claim 8, wherein at least one of the first and second rods has a slot for receiving the at least one hook portion therein.

10. A hanging file folder according claim 9, wherein the at least one of the first and second rods has a male portion and the at least one hook portion has a female portion, such that when the at least one hook portion is connected to the opposing ends of the at least one of the first and second rods, the male portion and female portion mate to secure the at least one hook portion to the at least one of the first and second rods.

11. A hanging file folder according claim 1, wherein the first wall, the second wall, or both, of the file folder body surrounds their respective first or second rods.

12. A hanging file folder according claim 1, wherein the first wall, the second wall, or both, of the file folder body is captured by the first or second rod, respectively.

13. A hanging file folder according to claim 1 in combination with a pair of spaced apart rails, wherein the hanging file folder is mounted to the pair of spaced apart rails, and wherein the pair of hook portions of the first and second rods each engage the pair of spaced apart rails for movement of the file folder and rods along the rails.

14. A method of forming a hanging file folder for mounting to a pair of spaced apart rails, the method comprising:

forming a first rod with a pair of hook portions on opposing ends thereof;

forming a second rod with a pair of hook portions on opposing ends thereof;

attaching a first wall of a file folder body to the first rod;

attaching a second wall of the file folder body to the second rod, and wherein at least one of the rods comprises a resilient structure for permitting at least one of the hook portions thereof to move longitudinally and dynamically adjust an effective length of its rod as the file folder and the rods are moved along the rails for accommodating variances in an angle at which the folder is mounted on the rails and a distance between the rails to maintain engagement therewith.

15. A method according to claim 14, further comprising:

forming the at least one of the hook portions of the at least one of the rods with the resilient structure.

16. A method according to claim 15, further comprising:

connecting the at least one of the hook portions with the resilient structure to the at least one of the first and second rods.

17. A method according to claim 14, further comprising:

forming a channel within the first and second rods.

18. A method according to claim 17 wherein the hook portions are crimped within the channel of the first and second rods.

19. A method according to claim 14, further comprising:

forming the first and second rods with a male portion;

forming the hook portions with a female portion, and connecting the female portions of the hook portions to the male portions of the rods, wherein the male portions of the rods mate with the female portions of the hook portions to secure the hook portions to the rods.

20. A method according to claim 14, wherein the rods are formed by roll forming, stamping, extruding, or punching.

21. A method according to claim 14, wherein the hook portions are formed by stamping, punching, injection molding, or extruding.

22. The method of claim 14, further comprising:

mounting the pair of hook portions of the first rod to a pair of spaced apart rails; and mounting the pair of hook portions of the second rod to the pair of spaced apart rails.

23. A hanging file folder in combination with a pair of spaced apart rails, wherein the hanging file folder is mounted to the pair of spaced apart rails, comprising:

a first rod with first and second hook portions on opposing ends thereof engaging the pair of spaced apart rails;

a second rod with third and fourth hook portions on opposing ends thereof engaging the pair of spaced apart rails;

a file folder body comprising first and second walls forming a pocket for holding materials therein;

the first wall of the file folder body being connected to the first rod and the second wall of the file folder body being connected to the second rod such that the pocket is suspended between the first and second rods; and wherein both of the first and second rods comprise a resilient structure for permitting at least one of the hook portions thereof to move longitudinally and dynamically adjust an effective length of its rod as the file folder and the rods are moved along the rails for accommodating variances in an angle at which the folder is mounted on the rails such that there is an increase in a derailing angle at which at least one of the hook portions disengages one of the pair of spaced apart rails.

24. A hanging file folder for mounting to a pair of spaced apart rails, comprising:

a first rod with first and second hook portions on opposing ends thereof;

a second rod with third and fourth hook portions on opposing ends thereof;

each hook portion comprising a hook for engaging the pair of spaced apart rails;

a file folder body comprising first and second walls forming a pocket for holding materials therein;

the first wall of the file folder body being connected to the first rod and the second wall of the file folder body being connected to the second rod such that the pocket is suspended between the first and second rods;

at least the first and the third hook portions comprising a mounting portion fixed along a length of its respective rod and a hook for longitudinal movement relative to the fixed mounting portion and its respective rod; and wherein each one of the at least first and third hook portions further comprises a resilient structure constructed and arranged between the mounting portion and the hook, the resilient structure being configured to permit the hook to move longitudinally with respect to its rod and thereby dynamically adjust a distance between the hook portions of each rod as the file folder and the rods are moved along the rails for accommodating variances in an angle at which the folder is mounted on the rails and a distance between the rails and maintaining engagement therewith.

25. A hanging file folder according claim 24, wherein the resilient structure is a tension spring.

26. A hanging file folder according claim 24, wherein the mounting portion of the at least first and third hook portions is configured to be removably attached to its respective rod.

27. A hanging file folder according claim 24, wherein the first and second rods each has a slot at at least one of its opposing ends for receiving the mounting portions of at least the first and the third hook portions therein.

28. A hanging file folder for mounting to a pair of spaced apart rails, comprising:

a first rod with first and second hook portions on opposing ends thereof;

a second rod with third and fourth hook portions on opposing ends thereof;

each hook portion comprising a hook for engaging the pair of spaced apart rails;

a file folder body comprising first and second walls forming a pocket for holding materials therein;

the first wall of the file folder body being connected to the first rod and the second wall of the file folder body being connected to the second rod such that the pocket is suspended between the first and second rods;

at least the first and the third hook portions comprising a mounting portion fixed along a length of its respective rod and a hook for longitudinal movement relative to the fixed mounting portion and its respective rod; and wherein each one of the at least first and third hook portions further comprises a resilient structure constructed and arranged between the mounting portion and the hook, the resilient structure being configured to permit the hook to move longitudinally with respect to its rod and thereby adjust a distance between the hook portions of each rod for accommodating variances in an angle at which the folder is mounted on the rails and a distance between the rails and maintaining engagement therewith, wherein each rod has a male portion at at least one end and wherein each mounting portion of the first and the third hook portions has a female portion, such that when the mounting portions of the first and the third hook portions are connected to the respective ends of the rods, each male portion and each female portion mates to secure the first and the third hook portions to its respective rod.

29. A hanging file folder according claim 24, wherein the first wall, the second wall, or both, of the file folder body surrounds their respective first or second rods.

30. A hanging file folder according claim 24, wherein the first wall, the second wall, or both, of the file folder body is captured by the first or second rod, respectively.

31. A hanging file folder according claim 24, wherein the second and the fourth hook portions each comprise a mounting portion fixed along a length of its respective rod and a moveably mounted hook; and wherein each one of the second and the fourth hook portions further comprise a resilient structure constructed and arranged between its mounting portion and its moveably mounted hook, the resilient structure configured to permit the hooks to move longitudinally with respect to its rod and thereby dynamically adjust an effective length of its rod as the file folder and the rods are moved along the rails for accommodating variances in an angle at which the folder is mounted on the rails and a distance between the rails and maintaining engagement therewith.

* * * * *